US005388968A

United States Patent [19]

Wood et al.

[11] Patent Number: 5,388,968

[45] Date of Patent: Feb. 14, 1995

[54] COMPRESSOR INLET VALVE

[75] Inventors: James A. Wood; Robert R. Ball, both of Concord, N.C.

[73] Assignee: Ingersoll-Rand Company, Woodcliff Lake, N.J.

[21] Appl. No.: 282,114

[22] Filed: Jul. 28, 1994

Related U.S. Application Data

[63] Continuation-in-part of Ser. No. 180,928, Jan. 12, 1994, abandoned.

[51] Int. Cl.[6] ..... F04B 49/00

[52] U.S. Cl. ..... 417/295; 417/505; 417/506; 137/487.5; 251/129.11

[58] Field of Search ..... 417/295, 505, 506; 137/487.5; 251/129.11

[56] References Cited

U.S. PATENT DOCUMENTS

| | | | |
|---|---|---|---|
| Re. 33,782 | 12/1991 | Fujita et al. | 251/129.11 |
| 2,192,512 | 3/1940 | Twiss | 417/295 |
| 2,404,514 | 11/1944 | McClure . | |
| 2,917,069 | 12/1959 | Lundy et al. | 251/129.11 |
| 4,052,135 | 10/1977 | Shoop et al. | 417/295 |
| 4,411,289 | 10/1983 | Walters . | |
| 4,523,436 | 6/1985 | Schedel et al. | 251/129.11 |
| 4,593,881 | 6/1986 | Yoshino | 251/129.11 |
| 4,884,590 | 12/1989 | Eber et al. | 251/129.11 |
| 4,968,218 | 11/1990 | Koivula et al. | 417/295 |
| 5,018,947 | 5/1991 | Tsuboi | 417/295 |
| 5,054,995 | 10/1991 | Haseley et al. . | |
| 5,318,151 | 6/1994 | Hood et al. | 417/295 |
| 5,352,098 | 10/1994 | Hood | 417/295 |

FOREIGN PATENT DOCUMENTS

| | | | |
|---|---|---|---|
| 0512667 | 11/1930 | Germany | 251/129.11 |

*Primary Examiner*—Richard A. Bertsch
*Assistant Examiner*—Howard R. Richman
*Attorney, Agent, or Firm*—Victor M. Genco, Jr.

[57] ABSTRACT

An electronically controlled gas compressor inlet valve includes a housing mounted on the compressor in fluid communication with an inlet of the compressor. A piston member is moveable linearly within the housing along a path of travel, into and out of occluding relation with the compressor inlet. A linear positioning device is connected to the piston member. The linear positioning device positions the piston member linearly, in a predetermined location, along the path of travel. A vent maintains a predetermined atmospheric pressure across the piston member. A sensor determines compressor inlet pressure, and generates a signal in response to a predetermined inlet pressure. A controller is operatively connected to the stepper motor for controlling actuation of the stepper motor in response to the signal generated by the sensor.

4 Claims, 2 Drawing Sheets

COMPRESSOR INLET VALVE

This is a continuation-in-part of application Ser. No. 08/180,928, which was filed on Jan. 12, 1994, now abandoned.

BACKGROUND OF THE INVENTION

This invention generally relates to a compressor inlet valve, and more particularly, to an electronically controlled linear actuated inlet valve for an air compressor.

The application of air compressors for supplying compressed air to pneumatic construction equipment and to industrial plant compressed air networks usually requires that the compressor be equipped with some form of compressor throughput or capacity control. It is well known to employ a piston or poppet type inlet valve, i.e. those inlet valves having a piston engageable with a seat, in air compressor design to control the throughput or capacity of a respective compressor. An attendant benefit gained from using this type inlet valve in air compressor design is that the operational characteristics of this type inlet valve are generally more linear, as compared with, for example, a butterfly type inlet valve. However, during operation of an air compressor having such an inlet valve, there is a net load on the piston inlet valve which is caused by a pressure differential across the valve.

The pressure differential which exists across a conventional piston inlet valve is established by the existence of atmospheric pressure ($P_{atm}$) on a first side of the piston and inlet pressure ($P_{inlet}$) on a second side of the piston, where $P_{inlet}$ is less than $P_{atm}$. Therefore, a net load force ($F_{net\ load}$) is exerted on the piston inlet valve. A shortcoming of a net loaded inlet valve is that an inlet valve control system must continuously, throughout compressor operation, compensate for the net load, which is typically accomplished through use of a predetermined control force ($F_{control}$), such that $F_{control}$ equals $F_{net\ load}$.

To date, piston type inlet valves have been controlled by pneumatic or hydraulic control systems because these type control systems are able to effectively generate a continuous $F_{control}$ of sufficient magnitude to stabilize the inlet valve in a predetermined position. Although such pneumatic or hydraulic control systems have operated with varying degrees of success, it is desirable to control compressor inlet valves with sensitive electronic controllers to increase compressor efficiency. However, sensitive electronic inlet valve control systems do not function effectively in such instances when these electronic control systems must continuously overcome a net load force ($F_{net\ load}$).

The foregoing illustrates limitations known to exist in present air compressor inlet valve designs. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an electronically controlled inlet valve for use with a gas compressor having an inlet and an outlet. The inlet valve includes a substantially cylindrical member operatively connected to the compressor. The substantially cylindrical member is moveable, linearly, along a predetermined path of travel, into and out of occluding relation relative to the compressor inlet. A linear positioning device is connected to the substantially cylindrical member for locating the substantially cylindrical member in a predetermined location along the path of travel. A pressure balancing apparatus maintains a predetermined pressure across the substantially cylindrical member. A sensor determines compressor inlet pressure, and the sensor generates a signal in response to a predetermined inlet pressure. A controller is operatively connected to the linear positioning device. The controller receives the signal generated by the sensor, and the controller actuates the linear positioning device in response to the sensor signal.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
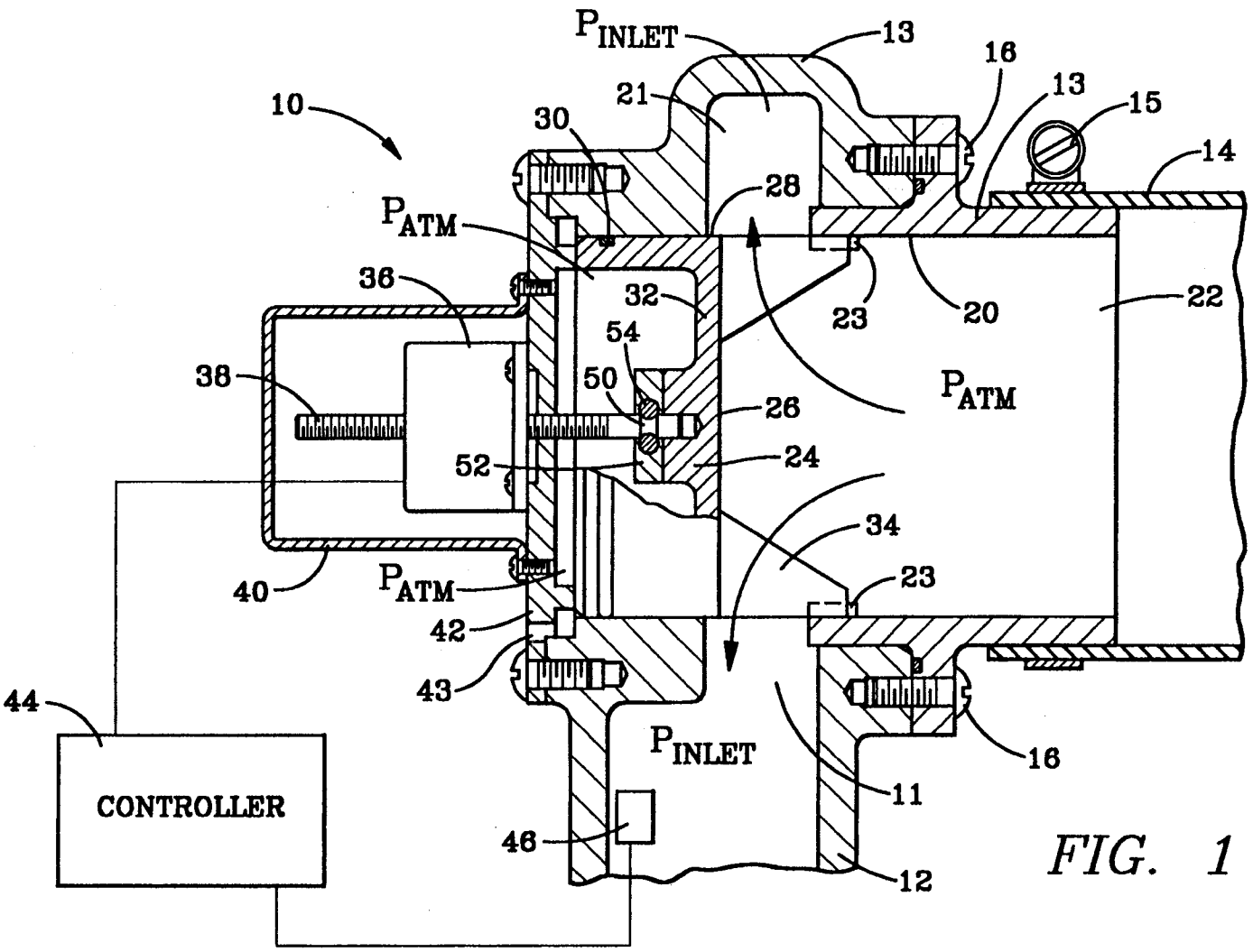
FIG. 1 is a partial sectional view of the apparatus of the present invention.

Referring now to the drawings, wherein similar reference characters designate corresponding parts throughout the several views, the embodiment of the apparatus shown in FIG. 1 comprises an electronically controlled inlet valve 10 for an air or gas compressor 12 according to one embodiment of the invention. The inlet valve 10 is operable to regulate the throughput or capacity of the compressor 12. In the preferred embodiment, the apparatus 10 is adapted for use in combination with a rotary screw compressor 12.

The compressor 12 includes an inlet housing 13 and inlet ducting 14 which communicates with a compressor inlet port 11 which receives a low pressure gas to be compressed, such as air for example, as is well known in the art. The inlet ducting 14 is connected with the inlet housing 13 by conventional methods, such as by way of a clamping apparatus 15. The compressor 12 also has a discharge port (not shown) for discharging the compressed air at a predetermined pressure to a compressed air system which may contain such common system elements as an oil/air separator receiver (not shown), and a service valve (not shown), for example. The compressed air which is supplied to the service valve may be used to provide motive force to a variety of pneumatic implements, such as pneumatic hand tools, for example.

The inlet housing 13 may be defined by a single structure or may be defined by a plurality of structure portions which are assembled to form a unitary inlet housing, as is illustrated in FIG. 1. More particularly, the illustrated embodiment of the inlet housing 13 includes first and second housing portions which are assembled to form a unitary inlet housing by way of threaded fasteners 16. The inlet housing 13 is mounted on the compressor 12 in fluid communication with the compressor inlet port 11.

The inlet housing 13 includes an interior surface 20 which defines a first inlet chamber 21 through which a low pressure gas, such as air, flows on its way to be compressed by the compressor 12. Additionally, the interior surface 20 defines a substantially cylindrical, second inlet chamber or region 22 which fluidly communicates with the first inlet chamber 21, and which provides a cylindrically shaped path of travel for a suitably dimensioned object, as will be discussed in further detail hereinafter. Formed on the interior surface 20 is at least one protuberance 23 having a predetermined dimension which also will be described in further detail hereinafter.

A substantially cylindrically shaped member 24, such as a piston member, is moveable, linearly, along a predetermined path of travel within the second inlet chamber 22, into and out of occluding relation relative to the compressor inlet port 11. More particularly, the piston member 24 is moveable along the path of travel from a first maximum position wherein the piston member is disposed in substantially non-occluding relation relative to the compressor inlet port 11, to a second maximum position wherein the piston member is disposed in substantially occluding relation relative to the compressor inlet 11. As should be understood, the piston member is disposed in the first maximum position in FIG. 1.

The piston member 24 is defined by a leading surface 26, a perimetral surface 28 which locates an O-ring 30, and a trailing surface portion 32. Connected on the piston member 24 is a means for preventing rotation of the piston member during its movement linearly along the path of travel. More particularly, and as illustrated in FIG. 1, the rotation prevention means includes at least one tab member 34 which is connected with the piston member 24. Formed in the tab member 34 is a channel or groove which is suitably dimensioned to operatively engage the protuberance 23 during operation of the inlet valve to thereby prevent rotation of the piston member 24 during its movement along the path of travel. As may be appreciated by one skilled in the art, the rotation prevention means may additionally comprise any number of equivalent structures which are operable to prevent rotation of the piston member 24 during its movement along the path of travel. For example, the tab member 34 may have formed thereon a tongue portion which may operatively engage a suitably dimensioned groove portion which may be formed in the interior surface 20.

A linear positioning device 36 is operatively connected to the trailing surface portion 32 of the piston member 24. In the preferred embodiment, a stepper motor, having a lead screw member 38 is connected to the trailing surface portion 32. (As used herein, stepper motor means a motor that rotates in short, essentially uniform angular movements rather than continuously.) The lead screw member 38, by operation of the stepper motor 36, positions the piston member 24, linearly, in a predetermined location along the path of travel to control compressor throughput or capacity. It is contemplated that the stepper motor will incorporate a conventional position sensor (not shown), such as a proximity switch or a position encoder for example, to provide position data of the piston member 24. The piston member position sensor may be operably connected to an electronic control means or controller 44 which is operable to control operation of the inlet valve 10, and therefore compressor capacity, by way of the stepper motor 36. The electronic controller 44 is described in further detail hereinafter.

As best seen by reference to FIG. 1, the lead screw member 38 narrows at position 50 to form a substantially smooth, circumferential groove about the lead screw member. The lead screw member 38 is insertable through a retainer 52, such as a collar, for example. The retainer 52 may be made integral with the trailing surface portion 32 of the piston member 24, or the retainer 52 may be a separate part to be fixedly attached to the trailing surface portion 32 by any suitable fastening method. Insertably positioned in the retainer 52, in predetermined positions, are a pair of pin members 54 which operate to retain the lead screw member 38 in a predetermined axial position relative to the retainer 52. As should be understood, as the lead screw member 38 is positioned axially by operation of the stepper motor 36, the lead screw member rotates freely within the retainer 52 to permit the piston member 24 to be positioned without experiencing any appreciable rotation.

As illustrated in FIG. 1, the stepper motor 36 is encased within a housing 40. The stepper motor 36 and the housing 40 are mounted on a mounting plate 42 which is removably attached to the inlet housing 13. Formed in either the inlet housing 13, or the mounting plate 42, or both, is a vent means 43 for maintaining a predetermined atmospheric pressure across the piston member. In this regard, the piston member 24, by design of the inlet valve 10, experiences no net pressure loads, and as such, the piston member 24 operates as a "pressure balanced piston". More particularly, the leading surface 26 of the piston member 24 experiences ambient or atmospheric pressure by way of the inlet ducting 14. Also, the trailing portion 32 experiences ambient or atmospheric pressure by way of the vent 43. By permitting both sides of the piston member 24 to be open to the atmosphere, the piston member 24 experiences no net pressure loads, which is particularly desirable when controlling the positioning of the piston member by way of delicate electronic controls.

The electronic controller 44 is microprocessor based and is operatively connected to the stepper motor 36 for controlling actuation of the stepper motor in response to a predetermined signal. An example of a microprocessor based controller which is suitable for controlling the inlet valve 10 as contemplated by the present invention is the electronic controller which is disclosed in U.S. Pat. No. 5,054,995, and which is incorporated herein by specific reference. As can be seen by reference to FIG. 1, the electronic controller 44 is disposed in signal transmitting relation to the stepper motor 36. Additionally, the electronic controller 44 is disposed in signal receiving relation to a pressure sensor 46 which is described in detail hereinafter.

The pressure sensor 46 senses compressor inlet pressure, and generates a signal in response to any predetermined inlet pressure. The signal generated by the pressure sensor 46 is communicated to the controller 44. The controller 44, by way of a predetermined logic routine, transmits positioning control data to the stepper motor 36 to position the piston member 24 in a desired location along the path of travel to achieve a predetermined compressor throughput or capacity.

Figure 2:
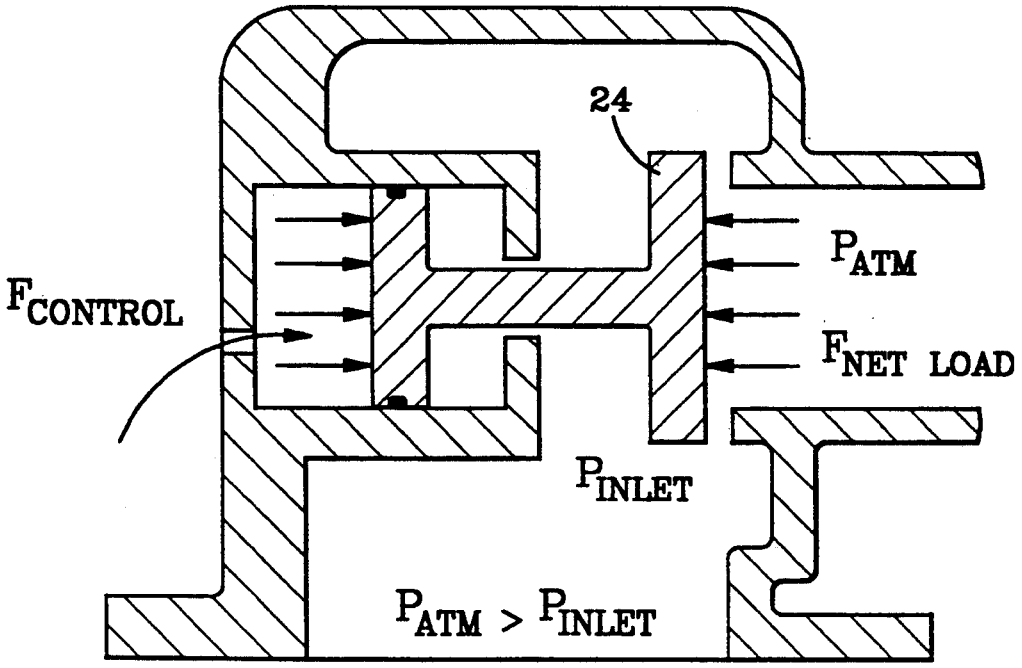
FIG. 2 (PRIOR ART)
FIG. 2 is a schematic diagram illustrating a net loaded prior art poppet or piston type valve.

FIG. 2 is a schematic diagram illustrating a net loaded prior art poppet or piston type valve. As illustrated, a pressure differential exists across a the piston member 24. This pressure differential is established by the existence of atmospheric pressure ($P_{atm}$) on a first side of the piston which is greater than an inlet pressure ($P_{inlet}$) which exists on a second side of the piston. Therefore, a net load force ($F_{net\ load}$) is exerted on the piston member 24. Prior art inlet valves have compensated for this net load force by providing a $F_{control}$ on the piston member 24 which is equal to $F_{net\ load}$, such as by employing a pneumatic or hydraulic control system.

In operation, the controller 44 receives an input pressure signal from the pressure sensors 46, and a position signal from the piston member position sensor (not shown). The controller 44 processes the pressure and the position inputs. Thereafter, a control signal, comprising a direction and number of steps, is transmitted by the controller to the stepper motor 36, which thereby locates the piston member 24 in a predetermined position along the path of travel, to thereby regulate the fluid throughput or capacity of the compressor 12.

As may be appreciated by one skilled in the art, the apparatus 10 is an advancement in the art, and advantageous in its use because the apparatus 10 permits the compressor 12 to run efficiently at full speed during periods of less than full capacity demand by supplying only the amount of air to the compressor inlet that is being used in the compressed air system by objects of interest. The present invention provides for an inlet valve which is free from net pressure loads which facilitates control of the inlet valve by delicate electronic control devices. Additionally, the linear path of travel of the piston member 24 provides for more accurate throttling of inlet air to the compressor which thereby increases over compressor efficiency.

While this invention has been illustrated and described in accordance with a preferred embodiment, it is recognized that variations and changes may be made therein without departing from the invention as set forth in the following claims.

Having described the invention, what is claimed is:

1. In combination with a compressor, an electronically controlled inlet valve comprising:

a housing mounted on the compressor in fluid communication with an inlet of the compressor;

a piston moveable axially within the housing along a path of travel defined by a first maximum position wherein the piston is disposed in substantially non-occluding relation relative to the compressor inlet, and a second maximum position wherein the piston is disposed in substantially occluding relation relative to the compressor inlet, and wherein the piston includes a means for preventing rotation of the piston during its movement linearly along the path of travel;

a stepper motor having a lead screw member which is connected to the piston wherein the lead screw member, by operation of the stepper motor, positions the piston linearly, in a predetermined location, along the path of travel;

atmospheric vent means, formed in the inlet housing, for reducing pressure loads across the substantially cylindrical member, the atmospheric vent means being disposed in direct fluid communication with the cylindrical member;

means for sensing compressor inlet pressure, the sensing means generating a signal in response to a predetermined inlet pressure; and a microprocessor based electronic controller, operatively connected to the stepper motor and disposed in communication with the sensing means, for controlling actuation of the stepper motor in response to the signal generated by the sensing means.

2. An inlet valve for a compressor comprising:

a compressor having an inlet, which fluidly communicates with a compression zone wherein a volume of fluid is compressed to a predetermined pressure, and an outlet;

an inlet housing mounted on the compressor in fluid communication with the compressor inlet;

a substantially cylindrical member operatively connected to the compressor and moveable axially within the inlet housing, along a predetermined path of travel, into and out of occluding relation relative to the compressor inlet;

means for positioning the substantially cylindrical member axially in a predetermined location along the path of travel;

atmospheric vent means, formed in the inlet housing, for reducing pressure loads across the substantially cylindrical member, the atmospheric vent means being disposed in direct fluid communication with the cylindrical member;

sensing means for determining compressor inlet vacuum, the sensing means generating an output signal representing the inlet vacuum; and a microprocessor based electronic controller which communicates with the sensing means, and which controls operation of the positioning means in response to the output signal of the sensing means.

3. An inlet valve, as claimed in claim 2, and wherein the substantially cylindrical member includes a means for preventing rotation thereof during its movement axially along the path of travel.

4. An inlet valve, as claimed in claim 3, and wherein the rotation prevention means includes at least one tab member having a channel formed therein, and wherein at least one protuberance, which is suitably dimensioned to operatively engage the channel, is formed on an interior housing surface, and wherein during operation of the inlet valve, the substantially cylindrical member is positioned axially while the channel and protuberance operatively interact to prevent rotation of the substantially cylindrical member.

* * * * *

UNITED STATES PATENT AND TRADEMARK OFFICE

CERTIFICATE OF CORRECTION

PATENT NO. : 5,388,968
DATED : February 14, 1995
INVENTOR(S) : James A. Wood and Robert R. Ball It is certified that error appears in the above-indentified patent and that said Letters Patent is hereby corrected as shown below:

On the title page, under item [19] and item [75],

Delete "James A. Wood" and replace with

--James A. Hood--

Signed and Sealed this

Twenty-fifth Day of April, 1995

*Attest:*

BRUCE LEHMAN

*Attesting Officer*

*Commissioner of Patents and Trademarks*